United States Patent [19]

Kuehnle et al.

[11] Patent Number: 4,526,357

[45] Date of Patent: Jul. 2, 1985

[54] ELECTRO-STATIC SHEET FEEDING METHOD AND APPARATUS

[75] Inventors: Manfred R. Kuehnle, New London, N.H.; Robert M. Rose, Sudbury; John S. Ballas, Newton, both of Mass.

[73] Assignee: Coulter Systems Corporation, Bedford, Mass.

[21] Appl. No.: 455,067

[22] Filed: Jan. 3, 1983

[51] Int. Cl.[3] ..... B65H 3/16

[52] U.S. Cl. ..... 271/18.2; 271/35; 271/128; 271/193

[58] Field of Search ..... 271/18.1, 18.2, 193, 271/35, 128

[56] References Cited

U.S. PATENT DOCUMENTS 2,627,890 2/1953 Lloyd ..... 271/18.1 X

FOREIGN PATENT DOCUMENTS 44445 3/1980 Japan ..... 271/18.1
640942 1/1979 U.S.S.R. ..... 271/18.1
825428 5/1981 U.S.S.R. ..... 271/18.1
906842 2/1982 U.S.S.R. ..... 271/18.1
950641 8/1982 U.S.S.R. ..... 271/18.1

*Primary Examiner*—Richard A. Schacher
*Attorney, Agent, or Firm*—Silverman, Cass & Singer, Ltd.

[57] ABSTRACT

Apparatus and a method are disclosed that can be selectively operated with equal advantage to strip sheet material from either the top or the bottom of a stack. A translatable member having a generally planar surface formed of an electrically insulative material is disposed proximate to either the top or bottom of a stack of sheet material. A pair of electrodes in the form of an electronic grid is secured to the planar surface. A DC voltage is applied to the electrodes selectively to effect a highly intense electric field only close to the surface of the member. The intensity of the electric field can be varied in predetermined relation to the applied DC voltage so as to determine the number of sheets simultaneously removed from the stack. The electric field exerts an attractive force only on the end-most sheet or sheets of the stack so that said end-most sheet or sheets only will be stripped from the stack.

16 Claims, 6 Drawing Figures

ELECTRO-STATIC SHEET FEEDING METHOD AND APPARATUS

BACKGROUND OF THE INVENTION

This invention relates generally to apparatus and a method for handling sheet material by electric field attractive forces and more particularly, provides apparatus and a method that can be selectively arranged above or below a stack of sheets for unstacking a desired number of sheets from either the top or the bottom of the stack without disturbing the remaining sheets of the stack and delivering the unstacked sheet or sheets to a predetermined location.

Sheet feeding from a stack largely has been performed using frictional forces between a sheet of the stack and means such as rollers. The rollers are urged against the top most sheet of the stack and the frictional forces between the rollers and top sheet are greater than between the top sheet and succeeding lower sheets. This differential in frictional forces is used to remove only the top sheet when the rollers are rotated. With such means, unstacking a sheet, especially automatically, can be a problem because of differences in the weight, consistency, porosity, folds or wrinkles and other quality characteristics of the sheet material, such as paper. Care has to be undertaken to use sheet material of uniform quality or to unstack the sheets manually where they are inconsistent in quality.

These sheet feeding or unstacking devices generally operate only to remove the top sheet of the stack and are unable to unstack the bottom sheet of the stack because to do so requires counteracting the weight of the stack. In many instances, means to select, unstack, and transport such a bottom sheet would be more desirable than operating upon the top of the stack.

No apparatus is known that will unstack a desired number of sheets such as one or two sheets from a stack.

It is known to remove sheets from the top of a stack using electrostatic principles. U.S. Pat. No. 3,726,520 discloses charging a film with a charged corona and extending the charged film over the top of a stack of sheets. The high voltage (5–6 Kilovolts) electrostatic charge on the film attracts the top-most sheet of the stack to the film. Thereafter, the film is withdrawn from over the top of the stack carrying the top sheet with it. Alternatively, U.S. Pat. No. 3,726,520 discloses charging a belt with charged coronas, raising a stack of sheets to a position with the top-most sheet directly under the charged portion of the belt so that the top-most sheet is attracted to the belt portion and lowering the stack. The belt then is rotated to carry the unstacked sheet to the desired location.

It is also known to convey and hold sheets using electrostatic principles. U.S. Pat. No. 4,244,465 discloses a belt formed of a base material carrying two groups of interdigitated and equally spaced apart electrodes. The two groups of electrodes are insulated from one another and are overcovered by a protective layer. The two groups of electrodes are energized to an undisclosed high voltage through contacts extending along the underside of the belt to produce an electrostatic field over the surface of the belt. A sheet of material placed on the outer surface of the belt is retained in relative position on the belt by the attractive force of the electrostatic field.

Apparatus that may be positioned above or below a stack of sheet material for removing a desired number of sheets from the top or bottom of the stack and a method for accomplishing same is not disclosed in the art.

SUMMARY OF THE INVENTION

In accordance with the invention there is provided apparatus and a method that alternatively can be located above or below a stack for selectively withdrawing or removing sheets of the stack from, respectively, the top or the bottom of the stack using electric fields and feeding the same to a selected location.

The method provides a translatable member formed of electrically insulating materials, having a generally planar surface, and having an exposed electronic grid secured thereon. The member is positioned with said generally planar surface at a position proximate or adjacent the stack of sheet material. A source of D.C. voltage is applied to said electronic grid, whereby an intense electric field is effected only close to the grid carrying surface and the adjacent sheet or sheets of said stack. A selected sheet or sheets is attracted by the intense field to the planar surface and transported by the member to the selected location, where said source of DC voltage is deactivated and said translatable member is returned to the position proximate the stack.

The electronic grid is formed of an electrode pair provided on a side surface of the translatable member. The electrodes are formed in comb-like configurations with connecting portions extending along the margins of the member and interleaved teeth extending across the planar surface. Connecting means are provided for coupling the electrodes to a DC voltage of generally substantially less than one thousand volts and possibly up to one thousand volts.

The member may be in the form of a belt or endless loop or it may be in the form of a rigid platen.

DESCRIPTION OF THE PREFERRED EMBODIMENT

The invention described herein provides apparatus for withdrawing or unstacking single or multiple sheets of material from a stack and delivering or feeding them to a desired or selected location. The invention herein will find utility wherever sheets of material must be handled.

The invention best will be understood by considering that the apparatus comprises a planar surfaced member or a member having a planar surface portion arranged alternatively below or above the stack. The member carries a grid of electrodes that are placed in contact with the sheet of material, such as paper. The electrodes are energized with a moderate voltage of generally substantially less than but up to one thousand volts to attract the contacted sheet to the member. The member then is translated in a plane parallel to the sheet to the desired location drawing the attracted sheet from the stack and with the member. The voltage then is removed to release the sheet from the attractive force and the sheet is carried from the member by other means.

The member may be in the form of a planar plate that is reciprocated relative to the stack for removal of sheets therefrom or the member may be in the form of a belt or endless loop carrying the grid of electrodes over only a portion of its outer surface, the belt being either reciprocated or moved in one direction to unstack the sheets.

The number of sheets that are removed from the stack may be varied by varying the voltage applied to effect the electric field attractive force; a higher voltage increases the number of sheets that may be fed from the stack at one translation of the member. The electric field attractive force is powerful enough to remove sheets not only from the top of the stack, but also from the bottom.

Figure 1:
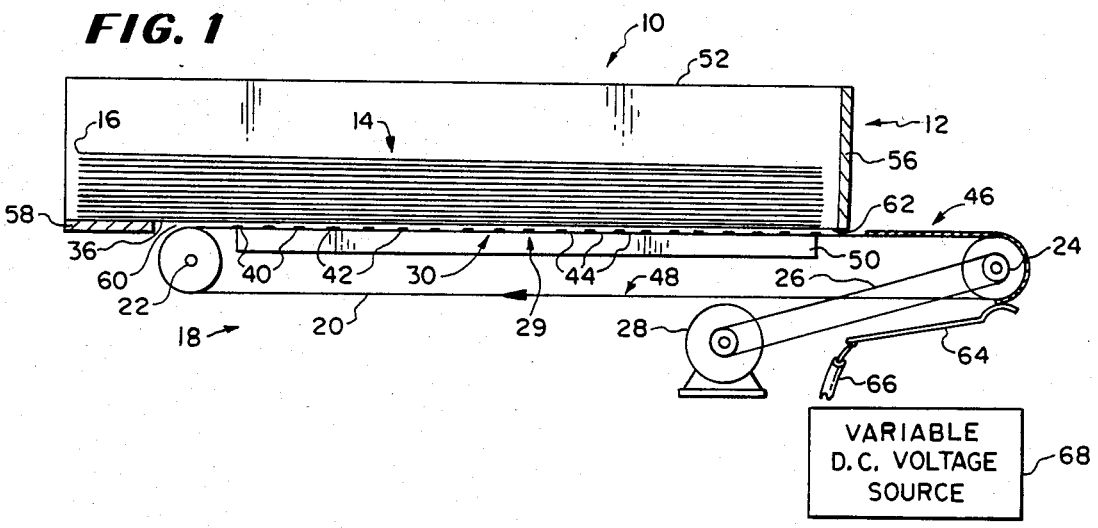
FIG. 1 is a side view partially in median section of the sheet feeding apparatus of the invention arranged located below a stack of sheet material carried in a magazine.

In FIG. 1, there is illustrated a sheet feeding apparatus of the invention indicated generally by the reference character 10. Apparatus 10 comprises a box-like magazine 12 storing therein a stack 14 of sheet material 16. A feed mechanism 18 is located below magazine 12 and comprises a translatable member 20 in the form of a belt or endless loop passing around two spaced rollers 22 and 24. Roller 24 is driven through a pulley arrangement 26 by a motor 28.

Figure 2:
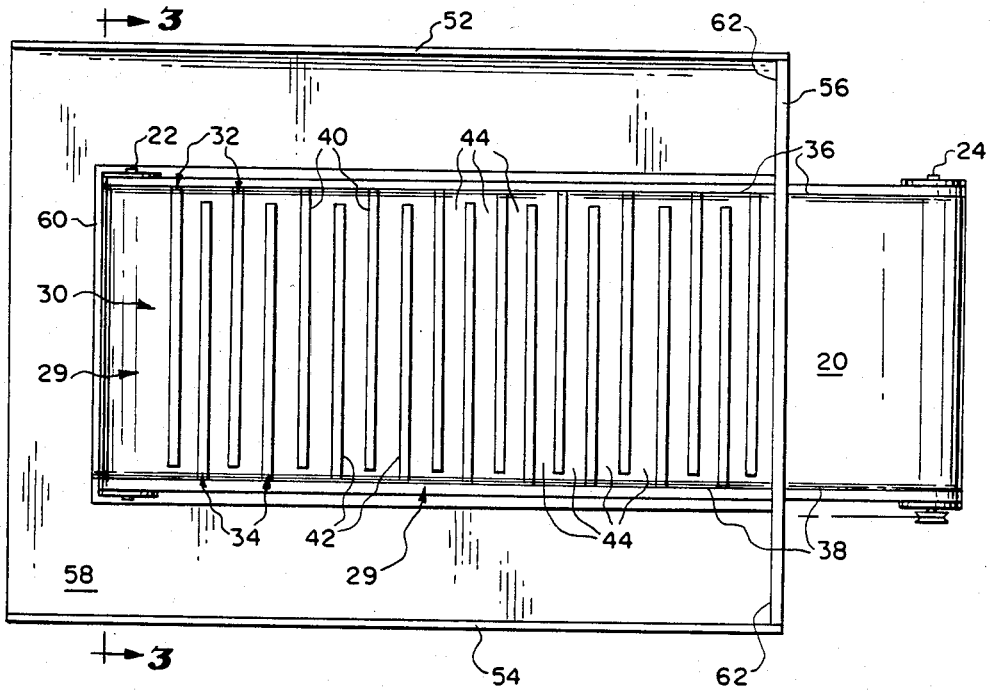
FIG. 2 is a plan view of the apparatus of FIG. 1 with the stack of sheet material omitted.

Member 20 is formed of an electrically insulative material that can be a transparent plastic film. Referring also to FIG. 2, member 20 carries along a generally planar portion 29 of its outer surface a grid 30 formed of a pair of electrodes 32, 34, indicated in FIG. 1 between the member 20 and the bottom-most sheet 36 of the stack 14. The electrodes 32, 34 are formed of conductive material such as a thin sheet of copper or stainless steel laminated onto the member 20 and etched to the desired configuration. Alternatively, the electrodes 32, 34 are formed on member 20 by thermal evaporation or sputtering, in which case the material of electrodes 32, 34 can be transparent, and may be such as indium oxide or tin oxide. A transparent member and electrodes could facilitate imaging through the member if desired. The electrodes 32, 34 are arranged in comb-like configurations with connecting portions 36, 38 extending along the length of member 20 and along opposite margins thereof. Teeth or stripes 40 and 42 of each electrode 32, 34 are electrically connected to their respective connecting portion and extend perpendicular therefrom towards the opposite connecting portion but are electrically insulated therefrom. The teeth or stripes 40, 42 of each electrode 32, 34 are arranged interleaved between the teeth or stripes of the other electrodes. The electrodes of grid 30 are exposed, there being no protective or other coating thereon.

The grid 30 thus forms a plurality of spaces 44 between the electrode teeth or stripes 40, 42 at which electric fields are created when the electrodes have a voltage placed across them.

Member 20 is pulled taut around the rollers 22, 24 to define upper and lower parallel reaches 46, 48. The member 20 is positioned so that the upper reach 46 is disposed between a fixed support plate 50 and the bottom-most sheet 36 of the stack 14. FIG. 1 illustrates grid 30 proximate the stack at the upper reach 46, the upper reach 46 providing a planar portion.

Magazine 12 is formed to have two side walls 52, 54, a front stop wall 56 and a bottom support wall 58. The top and rear of the magazine 12 are open for placing a stack of sheet material therein. Bottom wall 58 is provided with an aperture 60 for receiving the upper reach 46 of the member 20. There is a slit 62 between the bottom wall 58 and the front wall 56 through which sheets of the stack may exit the magazine 12, slit 62 extending from side wall 52 to side wall 54. The walls, aperture and slit are dimensioned as desired for receiving and storing a stack of sheet material and for sheets exiting same through slit 62.

Electrical connection to the connecting portions 36, 38 of the electrodes 32, 34 is by way of any connecting means desired such as a leaf spring 64 engaging connecting portion 38 at the circumference of roller 24. Leaf spring 64 is connected by a conductor wire 66 to a current limited D.C. voltage source 68. The electrodes are connected across the two terminals of source 68.

In operation, a stack of sheet material 14 is loaded in magazine 12. Stack 14 is supported by bottom wall 58 and by support 50 through member 20. Member 20 is moved around pulleys 22, 24 so that grid 30 is positioned along upper reach 46 with the electrodes 32, 34 closely spaced from or proximate stack 14 and below the bottom-most sheet 36 of stack 14. A voltage then is applied to the electrodes 32, 34 from source 68 through conductor 66 and spring 64. The voltage causes a plurality of electric fields to be created at spaces 40 and these fields apply an attractive force to bottom-most sheet 36, pulling sheet 36 into physical contact with grid 30 and member 20. The member 20 is then moved clockwise around pulleys 22, 24, substantially in a plane parallel the plane of the sheets 16, and because of the attractive force, the sheet 36 moves with the member 20 through slit 62 and out beyond the magazine. When the sheet 36 has been moved in translation a desired distance, the voltage is removed by source 68 and the sheet 36 is released from attraction to member 20. The sheet then may be removed from member 20 by any means desired. The remainder of the stack is held in magazine 12 by the front stop wall 56 and other known means such as corner nips. The feeding cycle then is completed by moving the member 20 counterclockwise to relocate the grid 30 proximate and below the stack 14. Additional sheets 16 are unstacked or fed from magazine 12 by repeating the described procedure.

It has been determined that single sheets of paper having a nominal thickness of 0.005 inch can be removed from the bottom of a stack of the same using a D.C. voltage of between 300–700 volts and with electrodes having teeth that are 0.020 inch wide and that are spaced apart 0.020 inch. Several factors such as paper thickness, humidity, etc. must be taken into account in varying these parameters to remove one sheet of different types of sheet stock. The parameters indicated are believed to provide intense electrical fields that extend about 0.005 inch normal to the plane of the electrode grid and that have significantly reduced intensities therebeyond. Thus, substantially all of the field extending above the surface of member 20 are contained in the bottom-most single sheet and minimally extend into the next to the bottom sheet.

It further has been determined that increasing the voltage applied to the electrodes to about 1 thousand volts, while maintaining the other parameters constant, provides for removal of the two bottom-most sheets from the stack. Additional numbers of sheets can be removed by increasing the electrode grid voltage and grid spacing.

Figure 3:
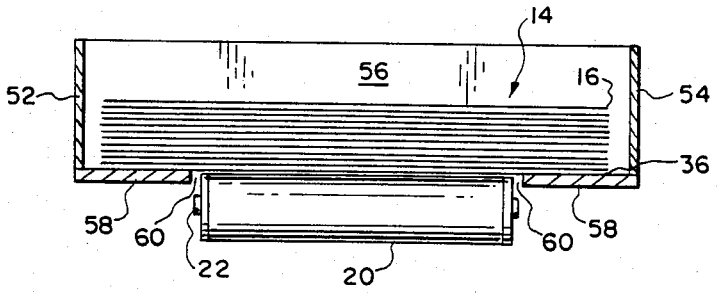
FIG. 3 is an end sectional view of the apparatus of FIG. 2 taken along the lines 3—3 in the direction indicated.
Figure 4:
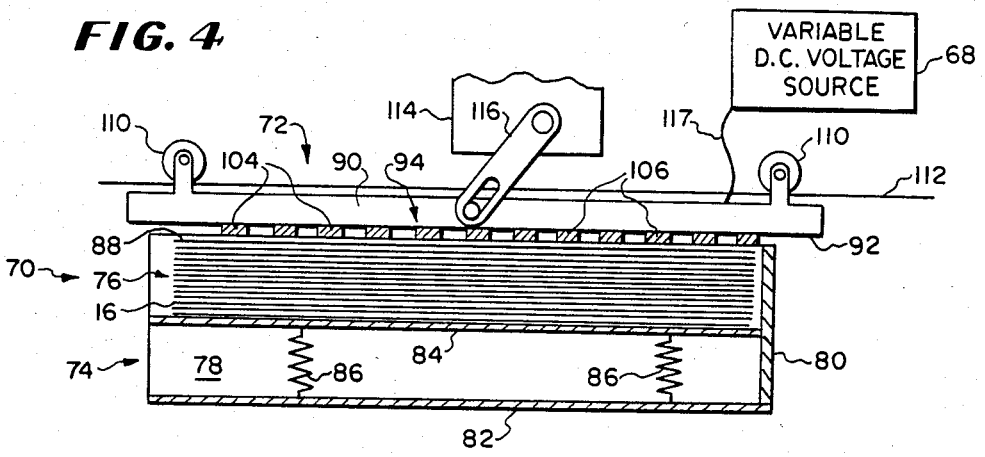
FIG. 4 is a side view partially in median section of an alternative embodiment of the invention.
Figure 5:
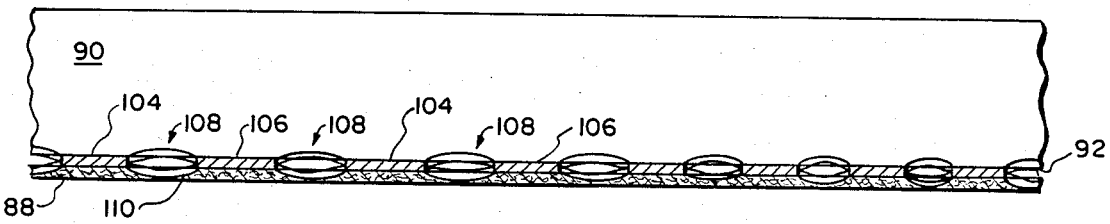
FIG. 5 is an edge view of the translatable member of FIG. 4 carrying a sheet of material therebelow illustrating the electric field lines of force produced between the electrodes thereof.
Figure 6:
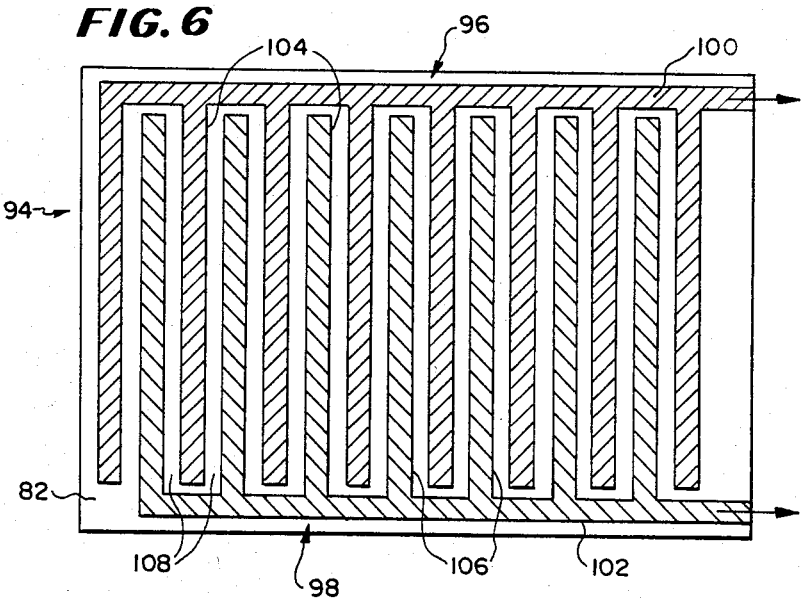
FIG. 6 is a diagram of the electrode grid of the apparatus of FIG. 4.

In FIGS. 4, 5 and 6 an alternative embodiment of the invention is illustrated. A sheet feeding apparatus is indicated generally by the reference character 70. Apparatus 70 comprises a feed mechanism 72 disposed above a magazine 74 containing a stack 76 of sheet material 16, which is the same as the sheet material described in connection with FIGS. 1–3.

Magazine 74 comprises a box-like structure having a pair of side walls 78, only one of which is shown, a front stop wall 80, a bottom wall 82 and a floating plate 84 supported above the bottom wall 82 by spring means such as conpression springs 86. Magazine 74 is open to the top and rear for receiving sheets of material therein. A door (not shown) may be provided to retain the stack within the magazine.

Magazine 74 is dimensioned and formed of materials as are desired to accomodate the sheet material. Plate 84 is dimensioned to support the sheet material interior of the magazine 74 and to move freely vertically therein. The springs 86 are formed to maintain the top-most sheet 88 of material 16 adjacent the top of magazine irregardless of the number of sheets in stack 76 or the weight of the sheets.

Feed mechanism 72 comprises a translatable member 90 in the form of a generally rectangular solid platen. Although the form of member 90 is different from that of member 20 described in FIGS. 1–3, the function of the two members is the same as will be described presently.

Member 90 has a generally planar bottom side surface 92 carrying an exposed grid 94 that comprises a pair of electrodes 96, 98, see FIG. 6. Electrodes 96, 98 each are formed of a connecting portion 100, 102 extending longitudinally of member 90 and teeth or stripes 104, 106 extending transverse of member 90 and being interleaved between one another. Spaces 108 are formed between teeth 104, 106 at which electric fields are formed when the electrodes are energized.

Member 90 is carried by such as four wheels 110 along a pair of rails 112, there being only two wheels 110 and one rail 112 being shown. Member 90 is reciprocally moved in translation in a plane substantially parallel the plane of the sheets along rails 112 by motor 114 through a pitman connection 116. Member 90 may be suspended above magazine 74 and reciprocally moved in translation across the top of magazine 74 by other means as may be desired. Connection of the D.C. voltage source 68 to member 90 may be by any means desired such as a flexible connection 117.

The operation of apparatus 70 is the same as the operation of apparatus 10, except apparatus 70 removes sheets of material from the top of stack 76. In operation, member 90 is positioned above the stack 76 with the grid 94 in contact with the top-most sheet 88 of material. The electrodes are energized by applying a voltage thereto to form electric fields at the spaces 108 and extending into the desired number of sheets of material to be removed, such as one or top-most sheet 88. The electric fields created at spaces 108 attract the top-most sheet 88 to the member 90 by applying an attractive force thereto. The member 90 then is moved in translation along rail 112 to a desired position where the unstacked sheet 88 is removed from member 90 for feeding to another mechanism as desired. Removal of sheet 88 from member 90 occurs by de-energizing the electrodes 96, 98. The member 90 then is reciprocated back into position above stack 76 for removal or unstacking of the next top-most sheet therefrom.

It has been determined that the apparatus 70 of FIGS. 4, 5 and 6 will repeatably feed sheets from the top of a stack at the rate of 1.2 cycles per second with 400 volts applied to the electrode grid. At slower rates, a voltage applied to the grid of 200 volts gave reliable feed results. These are not believed to be the operating limits of the apparatus but are cited as being exemplary. Atmospheric conditions and the qualities of the sheet material will dictate the operating limits of the apparatus. In any event, both of the apparatus of the invention herein operate at voltages significantly below the voltages disclosed in the prior art.

In FIG. 5, the electrodes 96, 98 carried by member 90 are energized to create electric fields at spaces 108. These fields are represented by field lines 110. The voltage applied across electrodes 96, 98 and fingers 104, 106 thereof is at a level to cause the fields to extend only a short distance normal to the bottom side surface 92 of member 90 and in the example illustrated in FIG. 5, the fields extend only the thickness of sheet 88 and not beyond. Additional sheets of material are attracted to the grid 94 and member 90 by increasing the voltage applied to electrodes 96, 98 so that the fields or field lines extend a further distance normal to the bottom surface 92, beyond the thickness of sheet 88 and into the desired number of an additional sheet or sheets.

The electrodes 96, 98 carried on member 90 and the electrodes 36, 38 carried on member 20 are exposed to the ambient atmosphere or whatever is placed in contact with the exterior surfaces of the respective member. There is no covering, protective or otherwise, that is overlaid on the grids. This is important because it provides that the voltages that are required to be applied to the electrodes can be substantially lower than if the electrodes were covered.

The apparatus and method described are not believed to place an electrostatic charge on the sheets 16 of material, such as is performed in the sheet handling apparatus of the prior art. The invention herein contemplates the use of electric fields applying an attractive force to a sheet of material without significantly depositing a charge on the sheet of material. The electric fields extend only a controlled distance normal to the electrode grid to the thickness of the desired number of sheets, and the electrode grid and carrying member are moved in translation in a plane parallel to the plane of the paper. The electrode grid substantially is not moved normal to the sheets and then parallel therewith as is known in the art.

It is believed that the attractive force of the electric fields holds the end sheet of the stack to the member 20 or member 90 sufficiently to overcome the frictional force between the end and the next in the stack. Effectively, the electric fields provide a normal force of such a magnitude so that the frictional force between the end and member 20 or member 90 is greater than the frictional force between the end sheet of the stack and the next sheet in the stack.

In removing a sheet from the bottom of the stack, the member 20 or member 90 should be stopped for at least an instant proximate the stack. This provides for action of the higher value static coefficient of friction and not the lower value sliding or dynamic coefficient of friction between the sheet or sheets and the member.

In the embodiment of FIGS. 1–3 and with the operating parameters described, the diameter of roller 24 can be dimensioned to about a $1\frac{1}{2}$ inch diameter so that the single sheet unstacked and carried by the member 20 will separate itself from the member 20 at roller 24 as the member curves around or conforms to the roller 24. This can be used to advantage where supplementary sheet handling apparatus is being fed the single sheet by mechanism 18.

The member 20 in the form of a belt may be moved continuously in a clockwise manner rather than reciprocating it so that the grid 30 is proximate and distant from the stack 14. Member 20 further may be provided with an additional grid or grids of electrodes to enhance the scheme of the operation of the feed mechanism 18. For example, with two grids formed on member 20, 180 degrees out of phase, the belts need be advanced only half a revolution to remove a sheet from the stack and align the next grid with the stack.

The member 20 further may be inverted and arranged adjacent the top of stack 14 for removal of sheets from the top of the stack using the same principles described herein. Likewise, the member 90 in the form of a platen may be inverted and arranged adjacent the bottom of the stack 14 for removal of sheets from the bottom of the stack using the same principles described herein.

The feed apparatus 10 and 70 are illustrated as being free standing. In practice they form a portion of a larger apparatus, device or mechanism that operates with or on the sheet material, and as such are mounted on said larger apparatus, device or mechanism.

What is claimed and desired to secure with Letters Patent of the United States of America is:

1. Apparatus for withdrawing at least one sheet from a stack of said sheets and feeding the same to a selected location comprising:

(A) a translatable member having a substantially planar surface portion selectively adapted to be closely arranged to one of the top-most and bottom-most sheets of said stack, the member being translatable in a plane substantially parallel to the plane of the sheets of said stack from a position adjacent said stack to said selected location, (B) said surface portion carrying fixed electrodes adapted to be directly exposed to said stack, but electrically insulated one from the other and constructed and arranged to form grid means which can be energized to provide a plurality of electric fields extending between said electrodes only a short distance normal to said surface portion; and (C) means for connecting said grid means to a D.C. voltage source for selectively energizing said grid means continuously from when said translatable member is adjacent the stack, so that said electrical fields operate to withdraw at least one sheet, until delivery of said at least one sheet to said selected location by the movement of said member, said at least one sheet so delivered being free of residual electrical charges thereon due to said exposed electrodes.

2. The apparatus of claim 1 in which each of said electrodes include a connecting portion and teeth, the teeth of the two electrodes being interleaved and spaced apart.

3. The apparatus of claim 2 in which the teeth have widths of about 0.020 inch and are spaced apart about 0.020 inch.

4. The apparatus of claim 1 in which said D.C. voltage source is selectively variable to apply a selected voltage to said grid means so that the electric fields created between the electrodes extend normal to the planar surface portion a distance less than the thickness of a single sheet of material and that a single sheet of material is fed from the stack.

5. The apparatus of claim 1 in which said D.C. voltage source is selectively variable to apply a selected voltage to said grid means so that the electric fields created between the electrodes extend normal to the planar surface portion a distance about equal to the thickness of a desired number of single sheets of material and that a desired number of sheets are removed from the stack.

6. The apparatus of claim 4 in which said D.C. voltage source is selected to apply a voltage to said grid means that is from about 300 to 700 volts for paper sheet material having a thickness of about 0.005 inch.

7. The apparatus of claim 5 in which said D.C. voltage source is selected to apply a voltage to said grid means that is about 1000 volts for paper sheet material having a thickness of about 0.005 inch to feed two sheets from said stack.

8. The apparatus of claim 1 further including movement means for moving said member, said movement means for bringing said member to a rest in said position adjacent said stack for at least an instant so that a static coefficient of friction acts between said sheet and member.

9. The apparatus of claim 1 in which said member is formed of a belt passing around spaced apart rollers so that said belt defines an upper reach and a lower reach, said upper reach forming said planar surface portion and said belt being arranged below said stack.

10. The member of claim 9 in which said belt and grid means are formed of transparent materials.

11. The apparatus of claim 1 in which said member is formed of a rigid platen having a bottom surface providing said planar surface portion, and said platen being arranged above said stack.

12. A method of withdrawing at least one sheet from a stack of said sheets and feeding the same to a selected location, comprising:

(A) providing a translatable member having a substantially planar surface portion, said surface portion carrying electrodes adapted to be exposed to said stack, electrically insulated one from the other and forming a grid;

(B) translating the member in a plane substantially parallel to the plane of the sheets from a position adjacent the stack, with the grid selectively adapted to be closely arranged to one of the top-most and bottom-most sheets of said stack, to said selected location; and (C) selectively energizing said electrodes with a D.C. voltage to provide a plurality of electrical fields extending between said electrodes only a short distance normal to said surface portion, said electrodes being energized continuously from when said member is adjacent the stack so that said electrical fields operate to withdraw at least one sheet until delivery of said at least one sheet to said selected location by the movement of said member, said one sheet so delivered being free of residual electrical charges thereon due to said exposed electrodes.

13. The method of claim 12 further including varying said voltage to be within a range of approximately 300 to 700 volts to withdraw one sheet from the stack.

14. The method of claim 12 further including varying said voltage to approximately 1000 volts to withdraw two sheets from said stack.

15. The method of claim 12 including energizing said electrodes with a D.C. voltage level selected to form electrical fields extending from said planar surface only the thickness of the desired number of sheets to be withdrawn from the stack.

16. The method of claim 12 including stopping the member for at least an instant at said position adjacent the stack to provide for action of the static coefficient of friction between the sheet and the member.

* * * * *